US007232387B1

(12) United States Patent
Heald et al.

(10) Patent No.: US 7,232,387 B1
(45) Date of Patent: Jun. 19, 2007

(54) TAMPER RESISTANT END CAP FOR A BAT

(75) Inventors: Jess H. Heald, Tullahoma, TN (US); Jared J. Smalley, Jr., Tullahoma, TN (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 0 days.

(21) Appl. No.: 11/130,005

(22) Filed: May 16, 2005

Related U.S. Application Data

(60) Provisional application No. 60/667,347, filed on Apr. 1, 2005.

(51) Int. Cl.
*A63B 59/06* (2006.01)

(52) U.S. Cl. ..... 473/566; 473/567

(58) Field of Classification Search ..... 473/564–568, 473/457, 519, 520
See application file for complete search history.

(56) References Cited

U.S. PATENT DOCUMENTS

| | | | | |
|---|---|---|---|---|
| 3,779,551 | A | 12/1973 | Wilson | 273/72 |
| 3,811,596 | A | 5/1974 | Wilson | |
| 5,303,917 | A | 4/1994 | Uke | |
| 5,380,047 | A | 1/1995 | Molee et al. | 283/86 |
| 5,421,572 | A * | 6/1995 | MacKay, Jr. | 473/566 |
| 5,490,669 | A | 2/1996 | Smart | 273/72 |
| 5,954,602 | A | 9/1999 | Eggiman et al. | |
| 6,254,139 | B1 | 7/2001 | Fresnel | 283/94 |
| 6,319,157 | B1 | 11/2001 | Broadbent | 473/446 |
| 6,440,017 | B1 | 8/2002 | Anderson | |
| 6,508,731 | B1 | 1/2003 | Feeney et al. | |
| 6,609,984 | B1 | 8/2003 | Tribble | |
| 2004/0038758 | A1 | 2/2004 | Guenther | |
| 2004/0221639 | A1 | 11/2004 | Woo et al. | |
| 2004/0224802 | A1 * | 11/2004 | Forsythe et al. | 473/564 |

* cited by examiner

*Primary Examiner*—Mark S. Graham
(74) *Attorney, Agent, or Firm*—Waddey & Patterson, P.C.; Phillip E. Walker

(57) ABSTRACT

A tamper deterring end cap for a bat. The bat includes a barrel, a taper, and a handle. The end cap comprises first and second elements integrally formed together such that attempted separation of the two elements distorts at least one of the elements. The second element can be integrally formed within the first element and the first element can include a securing member fixing the end cap to the barrel.

18 Claims, 5 Drawing Sheets

TAMPER RESISTANT END CAP FOR A BAT

CROSS-REFERENCES TO RELATED APPLICATIONS

This application is a Non-Provisional Utility application which claims benefit of co-pending U.S. Patent Application Ser. No. 60/667,347 filed Apr. 1, 2005, entitled "Tamper Resistant End Cap For A Bat".

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications described herein are hereby incorporated by reference in their entirety.

BACKGROUND OF THE INVENTION

The present invention relates generally to the end cap of a bat. More specifically, the present invention relates to a tamper deterring end cap used in connection with baseball and softball bats. This end cap deters access to the internal portions of the bat.

It will be appreciated by those skilled in the art that numerous prior art attempts have been made to improve bat and their functional characteristics. These improvements ranged from various materials used in the construction of the bat to various design configurations and components of the bat.

These improvements are tempered in part by the various regulatory agencies that organize, control, and sponsor the various baseball and softball leagues, events, and tournaments throughout the United States. These regulatory agencies have placed various limits upon the performance of bats in order to maintain a certain level of safety within the sport, to retain a high skill level for participants in the sports, and to maintain some historical perspective in the sports. Most of these restrictions reduce the reliance of the participant on improved technology in the bat's overall performance during play of the sport.

Unfortunately, several third parties have devised various methods and techniques to enhance the performance of a given bat in order to circumvent the restrictions from the regulatory bodies. Most of these illegal methods and techniques involve modifying the internal structure, components, or makeup of the bat. As such, the very purpose of most of the regulatory rules dealing with bats are circumvented by these individuals. This can have very serious effects in the overall safety and participation in the baseball or softball sports.

Most of these individuals access the internal portions of the bat through the end cap, which is positioned at the end of the barrel opposite the taper and handle portions of the bat. These individuals will typically remove the end cap from the bat, modify the bat, then replace the end cap. Normally the removal of the end cap from the bat requires drilling into the end cap and the use of a hook or grappling device to pull the end cap out of the barrel end of the bat. After the modifications have occurred, the individuals will attempt to replace the drilled portion of the end cap with some type of polymer, including polyurethane, epoxies, and plastics, and try to aesthetically blend the replaced end cap portion to the remainder of the end cap.

What is needed then is an end cap for a bat that deters tampering with the internal portions of the bat. This needed end cap should provide a manner in which a bat that has an end cap that has been modified, adjusted, or removed can be recognized. This needed end cap and bat containing such an end cap is lacking in the art.

BRIEF SUMMARY OF THE INVENTION

Disclosed herein is an end cap for a bat. The bat includes a barrel, a taper, and a handle. The end cap comprises first and second elements integrally formed together such that attempted separation of the two elements distorts at least one of the elements. The second element can be integrally formed within the first element and the first element can include a securing member fixing the end cap to the barrel.

Also disclosed is an end cap including a first element with a first design and a second element with a second design wherein the second design is positioned within the first design, such that removal of the second element from the first element distorts one of the designs. The first and second designs are preferably interrelated such that separation of the elements distorts the designs.

Also enclosed is an end cap comprising a first element affixing the end cap to an open end of the barrel. The first element includes a plurality of first armatures and a plurality of first apertures spaced between the first armatures. A second element is included and has a plurality of second armatures spaced between a plurality of second apertures. The first armatures securely fit within the second apertures and the second armatures securely fit within the first apertures. The interrelationship of the armatures and apertures between the first and second elements are such that removal of the first or second element from for the other element alters the shape of the first or second armatures and restricts insertion of the elements back together. The first and second armatures are positioned to restrict axial deflection of the first and second elements with respect to one another.

Preferably each first armature includes a first tapered surface and each second armature includes a second tapered surface corresponding to the first tapered surface. These first and second tapered surfaces are positioned in an opposed manner to restrict the movement of the first and second elements relative to one another.

The at least one securing member fixes the end cap within the barrel. The at least one securing member can include a retention surface positioned to maintain the end cap within the barrel. The securing member can also include an angled surface allowing insertion of the end cap into the barrel. Additionally, the first element can include a grasping location positioned to affix the end cap to the open end of the barrel.

The top surfaces of the first and second elements are preferably substantially flush with one another to provide a substantially flush end to the bat.

Also included is a method restricting access to the internal portion of a bat. The method comprises forming an end cap having a design that is deformed upon removal of the end cap from the barrel of the bat and positioning that end cap on the end of the barrel. Alternately, the method comprises forming an end cap having multiple elements that deform when separated from each other and positioning that end cap on the end of the barrel.

It is therefore a general object of the present invention to provide a tamper deterring end cap for a bat.

Another object of the present invention is to provide an end cap for a bat having first and second elements integrally formed together.

Another object of the present invention is to provide an end cap having an aesthetic design positioned on the end cap to prevent unnoticed removal of the end cap from the bat.

Yet another object of the present invention is to provide an end cap having multiple interrelated armatures restricting movement of the armatures with respect to one another.

Still another object of the present invention is to provide an end cap having multiple armatures interrelated such that the armatures deform upon attempted separation from one another.

Still another object of the present invention is to provide a method of restricting access to the internal portion of a bat.

Other and further objects, features and advantages of the present invention will be readily apparent to those skilled in the art upon reading of the following disclosure when taken in conjunction with the accompanying drawings.

DETAILED DESCRIPTION OF THE INVENTION

Figure 1:
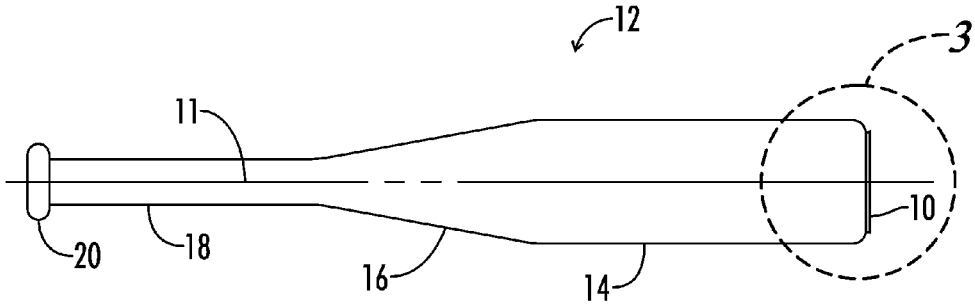
FIG. 1 is a side view of a bat made in accordance with the current disclosure.
Figure 2:
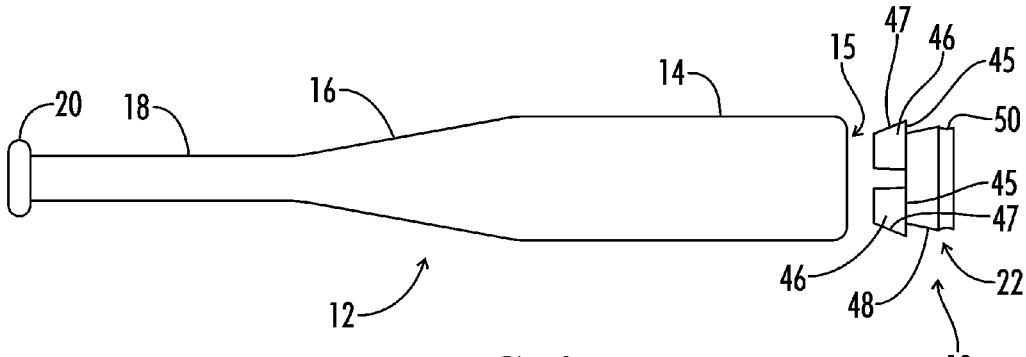
FIG. 2 is an exploded side view of the bat shown in FIG. 1.

Referring generally now to FIGS. 1–12, an end cap is shown and generally designated by the numeral 10. The end cap 10 is for a bat 12 having a barrel 14, a taper 16, and a handle 18. The taper 16 connects the barrel 14 and handle 18 and can be described as extending from the barrel 14. The handle 18 can be described as extending from the taper 16 and includes a knob 20 positioned opposite the taper 16. The barrel 14 includes an open end 15 designed to accept the end cap 10. Alternately stated, the end cap 10 can be designed to be positioned in the open end 15 of the barrel 14.

The end cap 10 can be positioned in the open end 15 of the barrel 14 to restrict access to the internal portion 13 of the bat. The end cap 10 includes an aesthetic design positioned on the end cap 10, and preferably in the end cap 10, to prevent removal of the end cap 10 from the barrel 14. The design is preferably formed by first and second elements 22 and 24 that are integrally formed within one another. The first and second elements 22 and 24 are integrally formed to restrict access to the barrel 14 through the open end 15. Removal of one of the elements 22 or 24 deforms the end cap 10 such that the end cap 10 cannot be properly repositioned in the open end 15 of the barrel 14.

In a preferred embodiment, the first element 22 includes a plurality of first armatures 26 and a plurality of first apertures 28 while the second element 24 includes a plurality of second armatures 30 and a plurality of second apertures 32. The combination of first armatures 26 and first apertures 28 can be described as forming a first design while the combination of second armatures 30 and second apertures 32 can be described as forming a second design. The first armatures 26 are designed to correspond to the second apertures 32 while the second armatures 30 are designed to correspond to the first apertures 28. Therefore, the first design can be described as substantially corresponding to the second design, or alternately the second design can be described as substantially corresponding to the first design.

The first and second designs are preferably positioned within one another and combined such that they are interrelated. A corresponding, overlapping nature of the first and second designs can result in a distortion of either one of the designs upon separation of the first element 22 from the second element 24, or removal of the second element 24 from the first element 22.

The first and second elements 22 and 24 can be positioned such that removal of the second element 22 from the first element, or removal of the first element 22 from the second element 24 alters the shape of the first armatures 26 or alters the shapes of the second armatures 30. This alteration to the shape of the armatures 26 or 30 results in a restriction to the reinsertion of the second element 24 into the first element 22. Additionally, the altered shape of the first or second armatures 26 or 30 deters axial deflection of the second element 24 with respect to the first element 22.

Each first armature 26 can include a first tapered surface 34 while each second armature 30 can include a second tapered surface 36. These tapered surfaces 34 and 36 are designed to correspond to one another and are positioned to restrict movement of the elements 22 and 24 with respect to one another. Preferably the tapered surfaces 34 and 36 restrict movement of the second element 24 away from the barrel 14. This placement of the tapered surfaces 34 and 36 ultimately facilitates the restricted movement of the second element 24 away from the first element 22 of the end cap 10 in a direction opposite the taper 16. The location of the first tapered surfaces 34 can be at the end of the protrusion 38 of each first armature 26 while the second tapered surface 36 can be in the neck 40 of each second armature 30.

The first and second armatures 26 and 30 are interrelated and positioned to restrict axial deflection of the first and second elements 22 and 24 with respect to one another. This restriction in movement is facilitated by the tapered surfaces 34 and 36 and the integral nature of the first and second elements 22 and 24. For example, preferably the first and second elements 22 and 24 are secured by a snug friction fit requiring a substantial amount of force in order to separate the two elements 22 and 24.

The second element 24 can be formed directly within the first element 22. The second element 24 can be of a different material than the first element 22 such that the first element 22 is formed around the second element 24. For example, the second element 24 can be a type of metal and the first element 24 can be a polymer molded around the metal.

Alternately, the second element 24 can be of the same material as the first element 22. For example the second element 24 can be a polymer formed, or molded, directly within the first element 22. The first element 22 can be clear, or transparent, such that the second element 24 can be readily viewed through the first element 22. Alternately, the second element 24 can include a top surface 42 that extends past the top surface 44 of the first element 22 such that the designs of the top surfaces 42 and 44 can bee seen. Alternately, the top surfaces 42 and 44 can be substantially flush such that both the top surfaces 42 and 44 can be seen from the barrel 14 of the bat 12.

The first element 22 can include a securing members 46 designed to fix the end cap 10 within the barrel 14. In a preferred embodiment, there are four securing members 46 spaced around the first element 22. The securing members 46 can be spaced around the wall 48 of the first element 22. The wall 48 can include a circumferential shape corresponding to the circumferential shape of the barrel 14. The wall 48 can include a taper from the top surface 44 of the first element 22 down to the securing members 46. Additionally, the first element 22 can include a grasping location 50 designed to correspond with the terminal end 52 of the open end of the barrel 14. The terminal ends 52 can curve inward towards to the axis 11 of the bat 12. In this embodiment, the grasping location 50 corresponds to the terminal end 52 to secure the end cap 10 in the open end 15 of the barrel 14. The grasping location 50 is preferably a groove around the circumferential wall 48 of the first element 22. This groove 50 facilitates the positioning of a majority of the end cap 10 within the open end 15 of the barrel 14 such that removal of the end cap 10 is more difficult, especially by unauthorized individuals.

Figure 3:
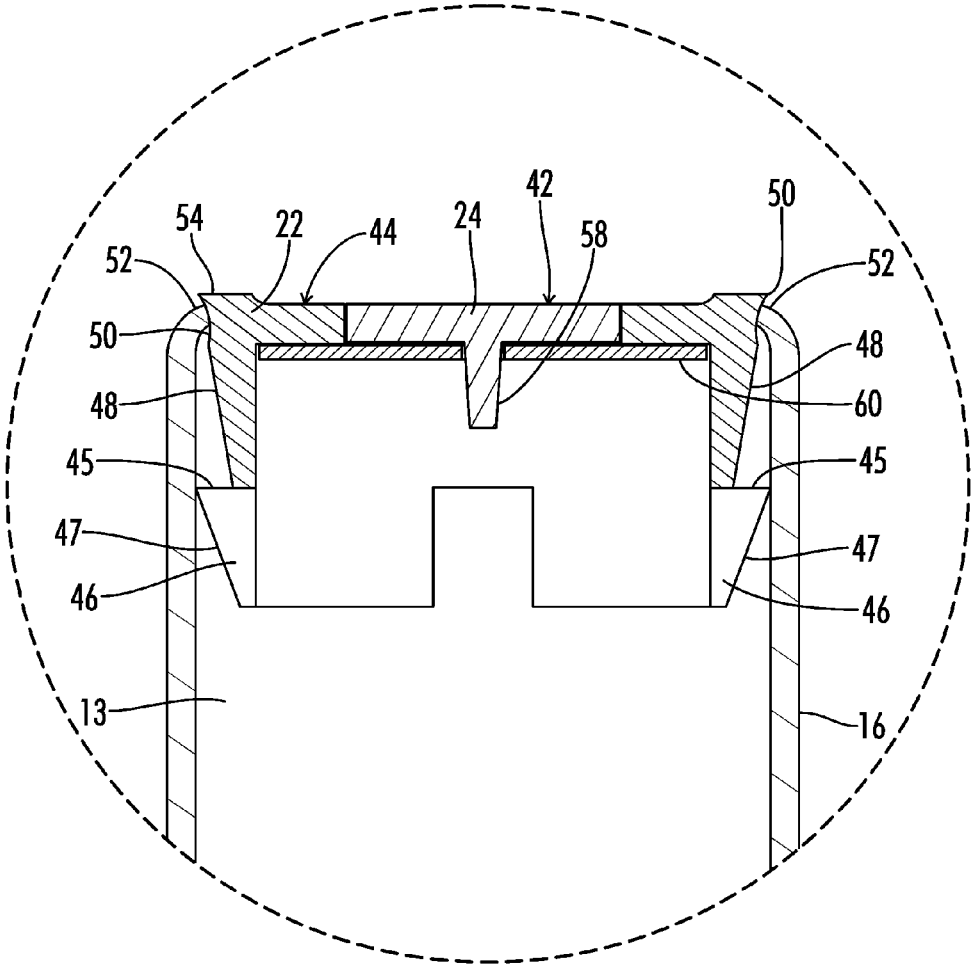
FIG. 3 is a cross-sectional view along line 3—3 of the area circled and indicated by the numeral 3 in FIG. 1.
Figure 4:
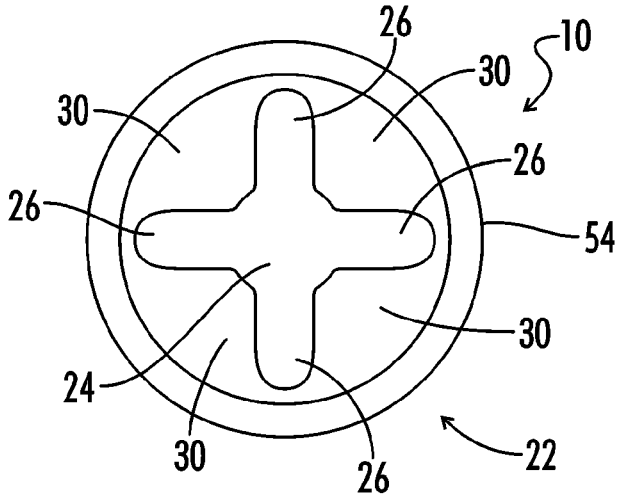
FIG. 4 is a top view of an embodiment of an end cap made in accordance with the current disclosure.
Figure 5:
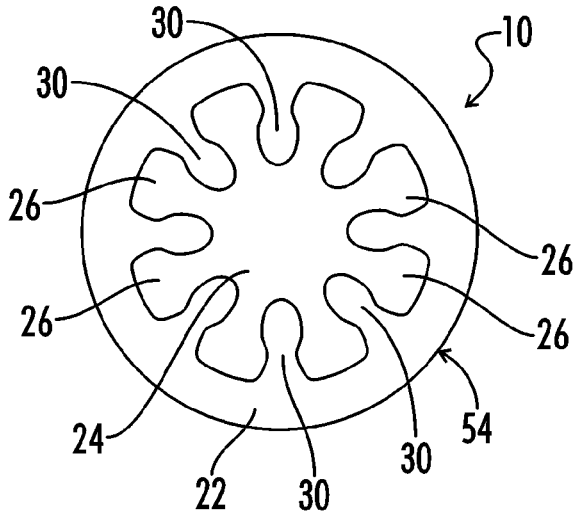
FIG. 5 is a top view of an alternate embodiment of an end cap made in accordance with the current disclosure.
Figure 7:
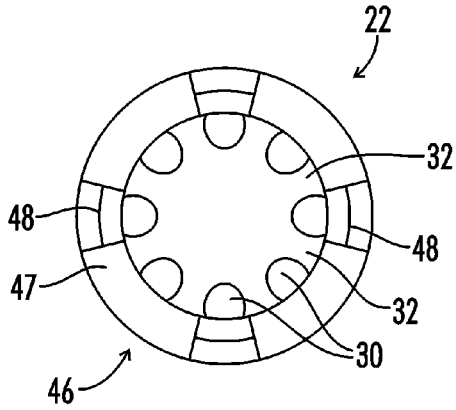
FIG. 7 is a bottom view of the embodiment of the first element shown in FIG. 6.
Figure 8:
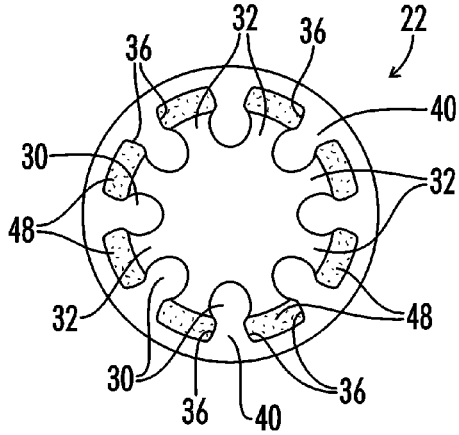
FIG. 8 is a top view of the embodiment of the first element shown in FIG. 6.
Figure 6:
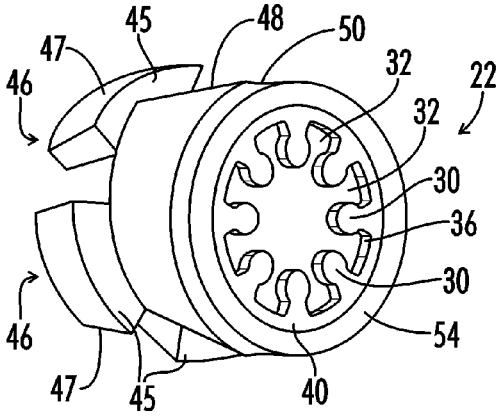
FIG. 6 is a perspective view of a first element of an end cap made in accordance with the current disclosure.
Figure 9:
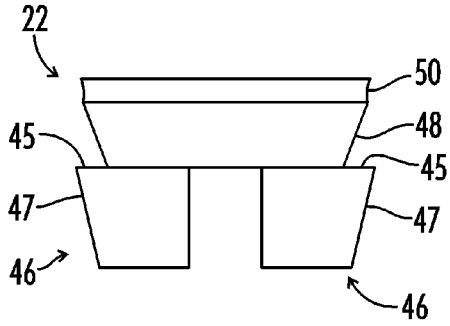
FIG. 9 is a side view of the embodiment of the first element shown FIG. 6.
Figure 10:
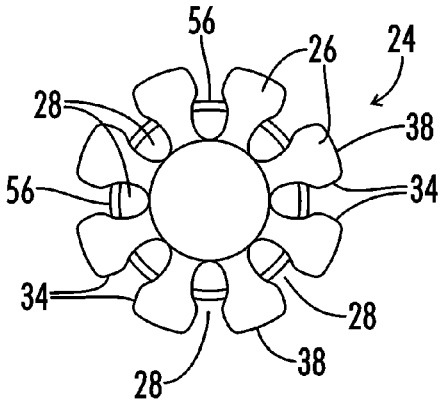
FIG. 10 is a top view of a second element made in accordance with the current disclosure.
Figure 11:
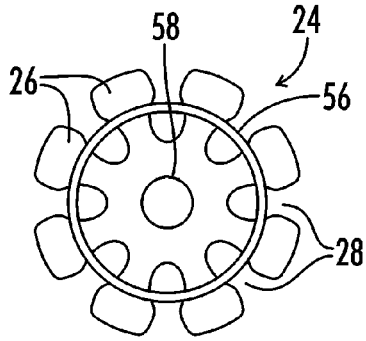
FIG. 11 is a bottom view of the embodiment of the second element shown in FIG. 10.
Figure 12:
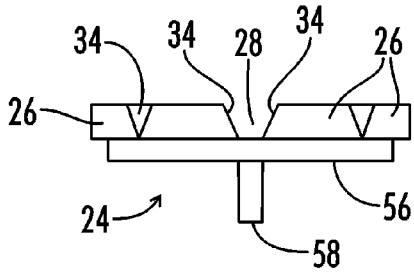
FIG. 12 is a side view of the embodiment of the second element shown in FIG. 10.

The top surface 44 of the first element 22 can include a rim 54, or edge 54 positioned around the circumference of the first element 22. Additionally, the top surface 44 can be substantially flush with the top surface 42 of the second element in a recessed manner as best illustrated in FIG. 3. This recessed manner once again makes it more difficult for an individual to remove the end cap 10 from the barrel 14.

The securing member 46 can include an angled surface 47 used to allow insertion of the end cap 10 into the barrel 14. The angled surfaces can facilitate the temporary radial deflection of the securing members 46 during the positioning of the end cap 10 in the barrel 14.

The second element 24 can include a support ring 56 positioned opposite the top surface 42. The sport ring can engage the first armatures 26 of the first element 22 to provide support and restrict axial movement of the first element 22 with respect to the second element 24. The support ring 56 can facilitate the integral nature of the first and second elements 22 and 24. A stanchion 58 can be positioned opposite the top surface 42 to further facilitate the integral nature of the first and second elements 22 and 24 and facilitate manufacturing of the end cap 10 when both elements 22 and 24 are molded together.

A disk support 60 can be positioned underneath the second element 24 as shown in FIG. 3. The disk support 60 can further restrict axial movement between the first and second elements 22 and 24.

The securing member 46 can include a retention surface 45 positioned on the securing member to affix the end cap 10 within the barrel 14. The retention surface 45 can be designed to engage the terminal ends 52 of the barrel 14. The terminal end 52 is preferably an inwardly curved end of the barrel 14.

The designs of the end cap 10 can be various designs and have various aesthetic looks as chosen by a producer or designer of the end cap 10 while maintaining the inventive nature of this disclosure. Numerous elements can be used to integrally connect, or form, the end cap 10 and ultimately the aesthetic design of the end cap 10 as seen from the barrel 14.

Thus, although there have been described particular embodiments of the present invention of a new and useful Tamper Resistant End Cap For A Bat, it is not intended that such references be construed as limitations upon the scope of this invention except as set forth in the following claims.

What is claimed is:

1. An end cap for a bat having a barrel, a taper, and a handle, the end cap comprising:

a first element; and a second element integrally formed within the first element;

wherein removal of the second element from the first element deforms at least one of the first or second elements;

wherein the first and second elements are visible from outside the barrel; and the first element includes a plurality of first armatures and a plurality of first apertures;

the second element includes a plurality of second armatures and a plurality of second apertures; and the first armatures are shaped to correspond with the second apertures and the second armatures are shaped to correspond with the first apertures.

2. The end cap of claim 1, the first element including at least one securing member fixing the end cap within the barrel.

3. The end cap of claim 2, the at least one securing member including a retention surface fixing the end cap within the barrel.

4. The end cap of claim 2, the at least one securing member including an angled surface allowing insertion of the end cap into the barrel.

5. The end cap of claim 1, wherein:

the first element further includes a first design;

the second element further includes a second design substantially corresponding to the first design.

6. The end cap of claim 1, wherein:

the first element includes a first top surface;

the second element includes a second top surface; and the first top surface is substantially flush with the second top surface.

7. The end cap of claim 1, wherein removal of the second element from the first element alters the shape of the first armatures.

8. The end cap of claim 7, wherein the altered shape of the first element restrict insertions of the second element into the first element.

9. The end cap of claim 1, wherein removal of the second element from the first element alters the shape of the second armatures.

10. The end cap of claim 9, wherein the altered shape of the second element restricts insertion of the second element into the first element.

11. The end cap of claim 1, wherein:

each first armature includes a first tapered surface;

each second armature includes a second tapered surface corresponding to the first tapered surface; and the first and second tapered surfaces are positioned to restrict the movement of the second element relative to the first element.

12. The end cap of claim 1, the second element including a support ring engaging the first armatures of the first element.

13. A end cap for a bat having a barrel, a taper and a handle, the barrel having an open end, the end cap comprising a first element securely fixing the end cap to the open end of the barrel and including a plurality of first armatures and a plurality of first apertures;

a second element including a plurality of second armatures and a plurality of second apertures, the second element separated from the barrel by the first element; and the first armatures securely fit within the second apertures and the second armatures securely fit within the first apertures, wherein removal of the second element from the first element deforms at least one of the first or second armatures.

14. The end cap of claim 13, wherein removal of the second element from the first element alters the shape of the first armatures and restricts insertion of the second element into the first element.

15. The end cap of claim 13, wherein removal of the second element from the first element alters the shape of the second armatures and restricts insertion of the second element into the first element.

16. The end cap of claim 13, wherein:

each first armature includes a first tapered surface;

each second armature includes a second tapered surface corresponding to the first tapered surface; and the first and second tapered surfaces positioned to the restrict movement of the second element relative to the first element.

17. The bat of claim 13, wherein the first and second elements form a design in the end cap.

18. An end cap for a bat having a barrel, a taper, and a handle, the end cap comprising:

a first element comprising a plurality of first armatures and a plurality of first apertures; and a second element integrally formed within the first element, the second element including an outer perimeter comprising:

a plurality of second armatures shaped to correspond with the first apertures;

a plurality of second apertures shaped to correspond with the first armatures; and a support ring spaced from the outer perimeter and engaging the first armatures of the first element.

* * * * *